US006506224B1

(12) United States Patent
Conochie

(10) Patent No.: US 6,506,224 B1
(45) Date of Patent: Jan. 14, 2003

(54) METHOD AND AN APPARATUS FOR UPGRADING A SOLID MATERIAL

(75) Inventor: David Stewart Conochie, Camberwell (AU)

(73) Assignee: K-Fuel L.L.C., Denver, CO (US)

( * ) Notice: Subject to any disclaimer, the term of this patent is extended or adjusted under 35 U.S.C. 154(b) by 0 days.

(21) Appl. No.: 09/485,528

(22) PCT Filed: Aug. 25, 1998

(86) PCT No.: PCT/AU98/00689

§ 371 (c)(1),
(2), (4) Date: May 12, 2000

(87) PCT Pub. No.: WO99/10079

PCT Pub. Date: Mar. 4, 1999

(51) Int. Cl.[7] ..... C10L 9/00; C10L 9/08
(52) U.S. Cl. ..... 44/626; 44/629
(58) Field of Search ..... 44/626, 620, 621, 44/629; 422/129

(56) References Cited

U.S. PATENT DOCUMENTS 4,477,257 A 10/1984 Koppelman et al.
5,071,447 A * 12/1991 Koppelman ..... 44/621
5,290,523 A 3/1994 Koppelman
5,746,787 A * 5/1998 Koppelman ..... 44/621
5,769,908 A * 6/1998 Koppelman ..... 44/621
6,126,904 A * 10/2000 Zuellig ..... 422/130

FOREIGN PATENT DOCUMENTS

EP 0 220 013 A2 10/1986

* cited by examiner

*Primary Examiner*—Cephia D. Toomer
(74) *Attorney, Agent, or Firm*—Harness, Dickey & Pierce, P.L.C.

(57) ABSTRACT

A method and an apparatus for upgrading a solid material is disclosed. The method comprises heating the solid material to an elevated temperature to remove water and thereafter cooling the upgraded solid material. The method includes providing a plurality of vessels containing packed beds of the solid material and one or more than one heat exchange circuit for heating and cooling the solid material in the packed beds in the vessels by heat exchange with a heat transfer fluid. The method is controlled so that the solid material in a first group of the vessels is at one or more stages of a heating cycle and the solid material in a second group of vessels is at one or more stages of a cooling cycle. Specifically, the method is controlled by selectively connecting the one or more than one heat exchange circuit to the vessels so that the heat transfer fluid recovers heat from the solid material undergoing the cooling cycle in at least one of the vessels in the first group and transfers the recovered heat to the solid material undergoing the heating cycle in at least one of the vessels in the second group.

12 Claims, 2 Drawing Sheets

Figure 1:
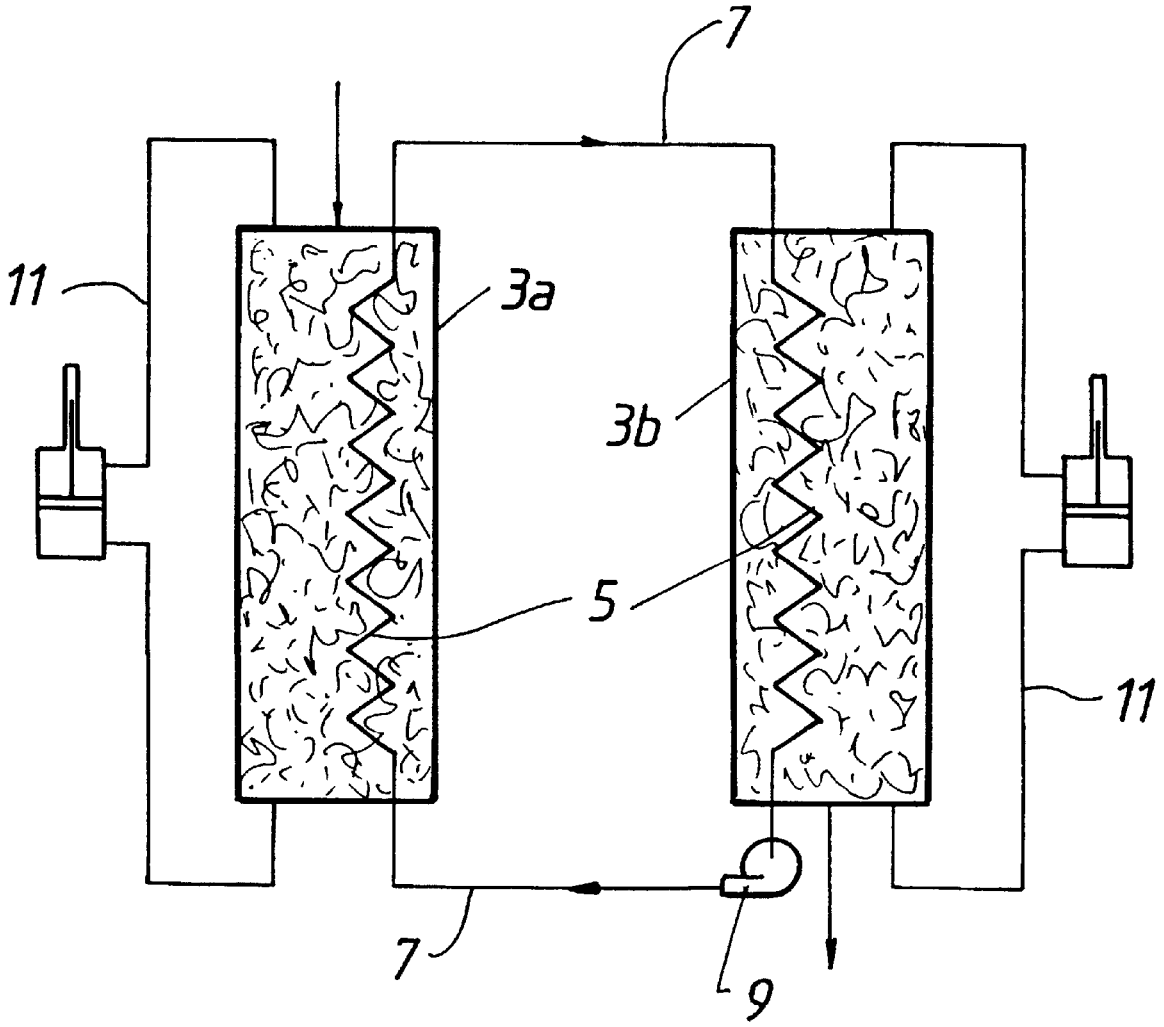

| | | | | | | | | | |
|---|---|---|---|---|---|---|---|---|---|
| A | 1 | 2 | 3 | 4 | 5 | 1 | 2 | 3 | 4 |
| B | 5 | 1 | 2 | 3 | 4 | 5 | 1 | 2 | 3 |
| C | 4 | 5 | 1 | 2 | 3 | 4 | 5 | 1 | 2 |
| D | 3 | 4 | 5 | 1 | 2 | 3 | 4 | 5 | 1 |
| E | 2 | 3 | 4 | 5 | 1 | 2 | 3 | 4 | 5 |

METHOD AND AN APPARATUS FOR UPGRADING A SOLID MATERIAL

This application is a 371 of PCT/AU98/00689,filed Aug. 25, 1998.

The present invention relates to upgrading a solid material.

The present invention relates particularly, although by no means exclusively, to upgrading a solid material which has low thermal conductivity.

The present invention relates more particularly to upgrading a solid material by removing water from the material in a process that includes:

(i) heating the material to an elevated temperature while the material is being maintained under high pressure; and thereafter (ii) cooling the upgraded material to an ambient temperature.

One particular application of the present invention is to upgrade carbonaceous material, typically coal, to increase the BTU value of the carbonaceous material.

U.S. Pat. No. 5,290,523 to Koppelman discloses a process for upgrading coal by the simultaneous application of temperature and pressure.

Koppelman discloses thermal dewatering of coal by heating coal under conditions including elevated temperature and pressure to cause physical changes in the coal that results in water being removed from the coal by a "squeeze" reaction.

Koppelman also discloses maintaining the pressure sufficiently high during the upgrading process so that the by-product water is produced mainly as a liquid rather than as steam.

Koppelman also discloses a range of different apparatus options for carrying out the upgrading process.

In general terms, the options are based on heating coal in a pressure vessel which includes an inverted conical inlet, a cylindrical body, a conical outlet, and an assembly of vertically or horizontally disposed heat exchange tubes positioned in the body.

In one proposal the vertically disposed tubes and the outlet end are packed with coal, and nitrogen is injected to pre-pressurise the tubes and the outlet end. The coal is heated by indirect heat exchange with oil that is supplied as a heat transfer fluid to the cylindrical body externally of the tubes. Further heating is promoted by direct heat exchange between the coal and steam that acts as a working fluid within the packed bed. In addition, the steam pressurises the tubes and the outlet end to a required pressure.

The combination of elevated pressure and temperature conditions in the tubes and the outlet end evaporates some of the water from the coal and thereafter condenses some of the water as a liquid. A portion of the steam generated following the addition of water also condenses as a liquid in colder regions of the tubes due to the elevated pressure. Steam which is not condensed and which is in excess of the requirements for optimum pressurization of the packed bed, must be vented. In addition, non-condensable gases (eg CO, $CO_2$) are evolved and need to be vented. Periodically, liquid is drained from the outlet end.

Finally, after a prescribed residence time, the vessel is depressurised and the hot upgraded coal is discharged via the outlet end onto a conveyor which transports the coal to a wet auger. Water is sprayed onto the hot upgraded coal as the conveyor transports the coal to the auger. The coal is cooled further in the auger and thereafter is spread out in a thin layer in a stockpile region and allowed to cool to ambient temperature.

An object of the present invention is to provide an improved method and apparatus for upgrading coal compared to that described by Koppelman.

According to a first aspect of the present invention there is provided a method of upgrading a solid material which comprises heating the solid material to an elevated temperature to remove water and thereafter cooling the upgraded solid material, and which method is characterised by:

(i) providing a plurality of vessels containing packed beds of the solid material and one or more than one heat exchange circuit for heating and cooling the solid material in the packed beds in the vessels by heat exchange with a heat transfer fluid; and (ii) controlling the method so that the solid material in a first group of the vessels is at one or more stages of a heating cycle and the solid material in a second group of vessels is at one or more stages of a cooling cycle, and the controlling step(s) comprises selectively connecting the one or more than one heat exchange circuit to the vessels so that the heat transfer recovers heat from the solid material undergoing the cooling cycle in at least one of the vessels in the first group and transfers the recovered heat to the solid material undergoing the heating cycle in at least one of the vessels in the second group.

The basis of the above-described aspect of the present invention is recovery of energy from the solid material being cooled in one group of vessels and subsequent use of that energy to heat the solid material in another group of vessels.

In one embodiment of the present invention a plurality of heat exchange circuits are provided and the heat exchange circuits selectively connect pairs of the vessels so that the heat transfer fluid of each heat exchange circuit cools the solid material in one vessel in each pair and thereafter heats the solid material in the other vessel in each pair by heat exchange with the solid material in the pair of vessels.

The heat transfer fluid in each heat exchange circuit heats and cools the solid material in the pairs of vessels to respective different temperatures in the heating and cooling cycles, with the result that the solid material in each vessel is heated or cooled by a series of steps by sequentially connecting the heat exchange circuits to the vessel.

For example, one heat exchange circuit heats solid material in one vessel from an ambient temperature to a temperature $T_1$ and another heat exchange circuit that is subsequently connected to that vessel heats the solid material from the temperature $T_1$ to a higher temperature $T_2$. At the same time, the heat exchange circuits cool the solid material in another vessel from the maximum temperature of the heating cycle to a lower temperature.

It is preferred that the contents of the vessel be at an elevated pressure during the heating and cooling cycles.

Solid material may be retained in one vessel during both the heating cycle and the cooling cycle.

Alternatively, solid material may be heated in one vessel during the heating cycle, transferred hot to another vessel, and cooled in accordance with the cooling cycle in the other vessel.

It is preferred that the heat exchange circuits heat and cool the solid material by indirect heat exchange.

The method of the present invention has great flexibility in terms of the heating and cooling cycles that can be applied to the solid material while obtaining the benefit of using heat recovered from the solid material that is undergoing the cooling cycle to heat the solid material that is undergoing the heating cycle.

By way of example, the method can be used to upgrade a solid carbonaceous material, such as coal, by the combined application of pressure and temperature which removes water from the coal in two stages, with:

(i) water being "squeezed" from the coal and drained as a liquid phase to a lower section of the vessel in a first, "wet", stage; and (ii) a substantial part of the remaining water in the coal being removed as a vapour phase in a second, "dry", stage.

The heat transfer fluid may be any suitable fluid for transferring energy by indirect heat exchange.

By way of example, the heat transfer fluid may be a fluid, such as oil, that is a single phase in the operating temperature range of the heating and cooling cycles.

By way of further example, the heat transfer fluid may be a fluid, such as water, that is in liquid and gaseous phases in the operating temperature range of the hea ting and cooling cycles and at suitable pressures.

The method may comprise one or more additional heating stages to complete the heating cycle.

The method may comprise one or more additional cooling stages to complete the cooling cycle.

The additional heating stage(s) may be provided by any suitable means, such as by oxidative heating in the vessels by supplying an oxygen-containing gas to the vessels.

The additional cooling stage(s) may be provided by any suitable means, such as by direct contact of coal with dry or wet air in the same or other vessel.

It is preferred that the method further comprises supplying a working fluid to the vessels to heat and cool the solid material by direct heat exchange with the solid material and to contribute to pressurising the contents of the vessels.

According to the first aspect of the present invention there is provided an apparatus for upgrading a solid material which comprises:

(a) a plurality of vessels for containing packed beds of the solid material under conditions of elevated temperature and pressure;

(b) one or more heat exchange circuits for heating and cooling the solid material in the packed beds by heat exchange with a heat transfer fluid;

(c) means for connecting the or each heat exchange circuit to the vessels so that in use the solid material in one group of the vessels is being heated in accordance with a predetermined heating cycle by the heat transfer fluid and the solid material in another group of the vessels is being cooled by the heat transfer fluid in accordance with a predetermined cooling cycle whereby in use the or each heat exchange circuit is connected to the vessels so that each heat exchange circuit removes heat from the solid material in at least one vessel and transfers the recovered heat to the solid material in at least on e other vessel; and (d) means for selectively changing the connections between the heat exchange circuits and the vessels to heat and cool the solid material in the vessels in accordance with the heating and cooling cycles.

The heat exchange circuit may be of any suitable configuration.

It is preferred that the heat exchange circuit comprises:

(i) heat exchange assemblies located in the vessels; and (ii) means for circulating heat transfer fluid through the heat exchange assemblies of the vessels and between the heat exchange assemblies of the vessels.

It is preferred particularly that the heat exchange assembly of each vessel comprises:

(i) an assembly of heat exchange plates having one or more passageways for heat transfer fluid positioned in the vessel;

(ii) an inlet for supplying the heat transfer fluid to the passageway (s); and (iii) an outlet for discharging the heat transfer fluid from the passageways(s).

It is preferred that the plates have minimal thermal mass.

It is preferred that the means for selectively changing the connections between the heat exchange circuit and the vessels includes a suitable control means.

According to a second aspect of the present invention there is provided a method of upgrading a solid material which comprises:

(i) charging the solid material into a vessel and forming a packed bed of the solid material in the vessel;

(ii) heating and pressurising the solid material to remove water from the solid material, the heating step comprising heating the solid material by indirect heat exchange with a heat transfer fluid;

(iii)cooling the solid material at the elevated pressure; and (iv) discharging the cooled upgraded solid material.

The basis of the above-described second aspect of the present invention is a multi-function vessel which receives a charge of the solid material and thereafter retains the solid material in a packed bed through the heating and cooling cycles.

One considerable advantage of the above-described method and apparatus of the present invention is that the use of multi-function vessels minimises materials handling of hot solid material compared to that required by Koppelman.

Another advantage is that the multi-function vessel minimises the cycle time associated with emptying, filling, pressure-up and pressure-down, compared to that required by Koppelman.

It is preferred that the heating step further comprises heating the solid material by direct heat exchange with a working fluid.

The energy recovery first aspect of the present invention may be carried out with or without using the multi-function vessel of the second aspect of the present invention.

Similarly, the multi-function vessel of the second aspect of the present invention may be used with or without the energy recovery first aspect of the present invention.

In one embodiment of the first aspect of the present invention, 5 vessels A, B, C, D, B contain packed beds of coal at elevated pressure and are at different stages of heating and cooling cycles of a method to upgrade the coal by removing water from the coal. The heating cycle of the method comprises:

(i) transferring heat to the coal and allowing water in the coal to be removed as a liquid phase in a first "wet" stage of the method; and (ii) transferring heat to the coal to boil at least a part of the remaining water in the coal as a vapour phase in a second "dry" stage of the method and thereafter heating the coal to a final product temperature.

The coal in each packed bed is heated and thereafter cooled by indirect heat exchange with heat transfer fluids that are pumped through heat exchange circuits that are sequentially connected to pairs of the vessels. The heat exchange circuit for each pair of vessels includes an assembly of heat exchange plates having one or more passageways for heat transfer fluid in each vessel and a means for circulating the heat transfer fluid through the heat exchange assemblies in the pair of vessels. This arrangement of a pair of vessels and heat exchange circuit is shown in FIG. 1. In the figure the vessel 3*a* contains a packed bed of coal that is in a heating cycle and the vessel 3*b* contains a packed bed of coal that is in a cooling cycle. The heat exchange plates in the vessels are identified by the numeral 5. The heat transfer circulation means includes the lines and pump which are identified by the numerals 7, 9.

The vessels and the heat exchange circuits may be any suitable type of pressure vessel, such as described in International applications PCT/AU98/00005 entitled "A Reactor" (which entered the U.S. National Phase as U.S. Ser. No. 09/341,406, tiled Sep. 13, 1999), PCT/AU98/00142 entitled "Process Vessel and Method of Treating A Charge of Material" (which entered the U.S. National Phase as U.S. Ser. No. 09/380,787, filed Nov. 29, 1999 and which issued as U.S. Pat. No. 6,249,989 on Jun. 26, 2001), PCT/AU98/00204 entitled "Liquid/Gas/Solid Separation" (which entered the U.S. National Phase as U.S. Ser. No. 09/367,083, filed Nov. 8, 1999 and which issued as U.S. Pat. No. 6,266,894 on Jul. 31, 2001), and PCT/AU98/00324 entitled "Enhanced Heat Transfer" (which entered the U.S. National Phase as U.S. Ser. No. 09/403,679, filed Feb. 8, 2000 and which issued as U.S. Pat. No. 6,185,841 on Feb. 13, 2001), all of which are commonly assigned to the assignee of this invention. The disclosure in these corresponding U.S. patents and patent applications is incorporated herein by cross reference.

The heating and cooling of the coal in the vessels is further promoted by supplying a working fluid to the packed beds in the vessels. The working fluid:

(i) heats and cools the coal by direct heat exchange between the coal and the working fluid and between the working fluid and the heat transfer fluid in the heat exchange circuits; and (ii) contributes to pressurising the contents of the vessels.

Working fluid circulation circuits are identified by the numeral 11 in FIG. 1.

The connections of the heat exchange circuits to the vessels are selected so that the heat transfer fluid recovers heat from one vessel that contains coal undergoing the cooling cycle and thereafter transfers heat to another vessel that contains coal undergoing the heating cycle.

Figure 2:
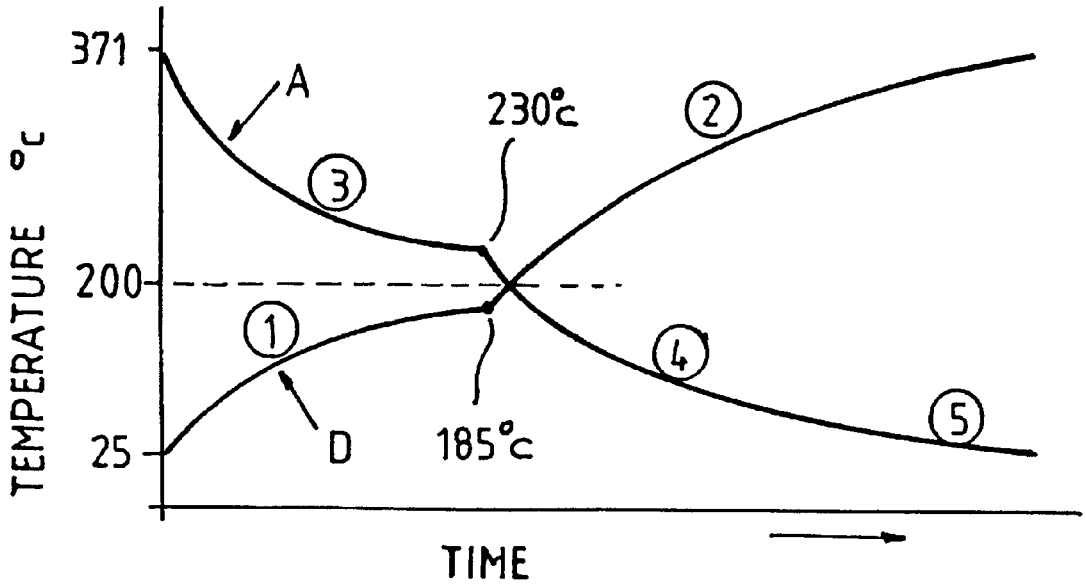

One example of a sequence of connections of a single heat exchange circuit to pairs of the vessels A, B, C, D, E is illustrated in FIG. 2. This is an example of a single stage energy recovery cycle.

FIG. 2 illustrates that, while vessel A contains a packed bed of coal at the final required product temperature of 371° C. and vessel D contains a packed bed of coal at an ambient temperature of 25° C., the connection of a heat exchange circuit to vessels A and D results in:

(i) cooling the coal in vessel A from 371° C. to 230° C., and (ii) heating the coal in vessel D from 25° C. to 185° C. by virtue of indirect heat exchange with the recovered heat from vessel A.

The above-described heat transfer connection of the packed beds of vessels A and B results in the beds approaching a common approach temperature—which is determined by relative heat capacity and any heat losses.

FIG. 2 also illustrates that subsequently providing additional cooling and heating to vessels A and D, respectively results in:

(i) further cooling of the coal in vessel A from 230° to the ambient temperature; and (ii) further heating of the coal in vessel A to the final required product temperature of 371° C.

The additional cooling and heating may be provided by a chiller and a boiler or any other suitable means.

It can readily be appreciated from the above discussion and FIG. 2 that selectively connecting the heat exchange circuit that heated and cooled the coal in vessels A and D to other pairs of the vessels A, B, C, D, E in accordance with the sequence shown in the table that forms part of FIG. 2 and selectively providing external heating and cooling of the vessels as described for vessels A and D results in similar heating and cooling of the coal in the vessels.

Many modifications may be made to the above-described method and apparatus for upgrading a solid material without departing from the spirit and scope of the present invention.

By way of example, the first aspect of the present invention is not restricted to the single stage energy recovery cycle with 5 reactors described in relation to FIG. 1. By way of example, the first aspect extends to a 2 stage energy recovery cycle with additional heating and cooling in 3 vessels. With this arrangement, the heating and cooling stages are arranged countercurrent in time and there are 2 approach temperatures, typically 240° C. and 150° C. More specifically, the 2 stage energy recovery cycle is as follows. A hot vessel A which has just completed a heating cycle is connected to a colder vessel B and transfers heat which heats vessel B in the second stage of heating. When the higher of the two approach temperatures is reached, vessel A is connected to a cold vessel C and transfers heat which heats vessel C in the first stage of heating. Finally, when the lower approach temperature is reached, vessel A is connected to a chiller to complete cooling of the coal in the vessel and deliver cold final coal. Vessel B, which has been heated in the second stage of heating to the higher approach temperature is connected to a steam supply circuit to complete the heating cycle of the coal in the vessel. It can readily be appreciated that this sequence of heating and cooling the vessels with fresh packed beds of coal can be repeated.

What is claimed is:

1. A method of upgrading a solid carbonaceous material which comprises heating the solid carbonaceous material to an elevated temperature to remove water and thereafter cooling the upgraded solid material, which method comprises the steps of:

(i) providing a plurality of vessels containing packed beds of the solid carbonaceous material and at least one heat exchange circuit for heating and cooling the solid material in the packed beds in the vessels by heat exchange with a heat transfer fluid; and (ii) controlling the method so that the solid material in a first group of the vessels is at one or more stages of a heating cycle and the solid material in a second group of vessels is at one or more stages of a cooling cycle, and the controlling step comprises selectively connecting the at least one heat exchange circuit to the vessels so that the heat transfer fluid recovers heat from the solid material undergoing the cooling cycle in at least one of the vessels in the first group and transfers the recovered heat to the solid material undergoing the heating cycle in at least one of the vessels in the second group.

2. The method defined in claim 1 wherein step (ii) comprises selectively connecting pairs of the vessels so that the heat transfer fluid of the at least one heat exchange circuit cools the solid carbonaceous material in one vessel in each pair and thereafter heats the solid carbonaceous material in the other vessel in each pair by heat exchange with the solid carbonaceous material in the pair of vessels.

3. The method defined in claim 2 wherein the heat transfer fluid in the at least one heat exchange circuit heats and cools the solid carbonaceous material in the pairs of vessels to respective different temperatures in the heating and cooling cycles, with the result that the solid carbonaceous material in each vessel is heated or cooled by a series of steps by sequentially connecting the at least one heat exchange circuit to the vessel.

4. The method defined in claim 3 wherein one said heat exchange circuit heats solid carbonaceous material in one vessel from an ambient temperature to a temperature $T_1$ and another said heat exchange circuit that is subsequently connected to that vessel heats the solid carbonaceous material from the temperature $T_1$ to a higher temperature $T_2$.

5. The method defined in claim 1 further comprising maintaining the contents of each vessel at an elevated pressure during the heating and cooling cycles.

6. The method defined in claim 1 further comprising retaining the solid carbonaceous material in one vessel during both the heating cycle and the cooling cycle.

7. The method defined in claim 1 further comprising heating the solid carbonaceous material in one vessel during the heating cycle, transferring the hot solid carbonaceous material to another vessel, and cooling the solid carbonaceous material in accordance with the cooling cycle in the other vessel.

8. The method defined in claim 1 wherein the at least one heat exchange circuit heats and cools the solid carbonaceous material by direct heat exchange.

9. The method defined in claim 1 wherein the at least one heat exchange circuit heats and cools the solid carbonaceous material by indirect heat exchange.

10. The method defined in claim 9 further comprising supplying a working fluid to the vessels to heat and cool the solid carbonaceous material by direct heat exchange with the solid carbonaceous material and to contribute to pressurizing the contents of the vessels.

11. An apparatus for upgrading a solid carbonaceous material which comprises:

(a) a plurality of vessels for containing packed beds of the solid carbonaceous material under conditions of elevated temperature and pressure;

(b) a heat exchange assembly located in each vessel for heating and cooling the solid carbonaceous material in the packed beds by heat exchange with a heat transfer fluid;

(c) means for circulating heat transfer fluid through the heat exchange assemblies of the vessels and between the heat exchange assemblies of the vessels so that in use the solid carbonaceous material in one group of the vessels is being heated in accordance with a heating cycle by the heat transfer fluid and the solid carbonaceous material in another group of the vessels is being cooled by the heat transfer fluid in accordance with a cooling cycle whereby in use each heat exchange circuit is connected to its corresponding vessel so that heat from the solid carbonaceous material in at least one vessel is removed and the removed heat is transferred to the solid carbonaceous material in at least one other vessel; and (d) means for selectively changing the connections among the heat exchange assemblies to heat and cool the solid carbonaceous material in the vessels in accordance with the heating and cooling cycles.

12. The apparatus defined in claim 11 wherein the heat exchange assembly of each vessel comprises:

(i) an assembly of heat exchange plates having one or more passageways for heat transfer fluid positioned in the vessel;

(ii) an inlet for supplying the heat transfer fluid to the passageway(s); and (iii) an outlet for discharging the heat transfer fluid from the passageway(s).

* * * * *